US005777249A

United States Patent [19]

Suzuki

[11] Patent Number: 5,777,249

[45] Date of Patent: Jul. 7, 1998

[54] ELECTRONIC MUSICAL INSTRUMENT WITH REDUCED STORAGE OF WAVEFORM INFORMATION

[75] Inventor: Hideo Suzuki, Hamamatsu, Japan

[73] Assignee: Yamaha Corporation, Japan

[21] Appl. No.: 548,434

[22] Filed: Oct. 26, 1995

[30] Foreign Application Priority Data

Oct. 31, 1994 [JP] Japan ..... 6-288575

[51] Int. Cl.[6] ..... G10H 1/00; G10H 1/02

[52] U.S. Cl. ..... 84/604; 84/622; 84/623

[58] Field of Search ..... 84/603–608, 622, 84/623

[56] References Cited

U.S. PATENT DOCUMENTS

| | | | |
|---|---|---|---|
| 4,781,086 | 11/1988 | Suzuki et al. | 84/1.01 |
| 4,916,996 | 4/1990 | Suzuki et al. | 84/603 |
| 5,416,264 | 5/1995 | Toda et al. | 84/603 |
| 5,451,707 | 9/1995 | Suzuki | 84/604 |
| 5,461,189 | 10/1995 | Higashi et al. | 84/601 |

FOREIGN PATENT DOCUMENTS 6-138880 5/1994 Japan .

*Primary Examiner*—William M. Shoop, Jr.
*Assistant Examiner*—Marlon T. Fletcher
*Attorney, Agent, or Firm*—Graham & James LLP

[57] ABSTRACT

An electronic musical instrument comprises an analysis section, an excitation-waveform memory and a synthesis section. In the analysis section, difference data, which are calculated between target-sound data and output of an analysis loop, are subjected to compressive coding to produce compressed data. The compressed data are stored in the excitation-waveform memory as excitation-waveform data. The analysis loop, containing at least a delay circuit, is driven by an excitation signal which is produced by expanding the compressed data. In the synthesis section, the excitation-waveform data, read out from the excitation-waveform memory, are expanded; and expanded data are added to output of a synthesis loop, containing at least a delay circuit, so as to produce musical tone data representative of a musical tone to be generated. By arbitrarily selecting coefficients for compression and expansion which are respectively performed in the analysis section and synthesis section , the musical tone data are controlled to be an equivalence of the target-sound data. Further, the excitation-waveform memory is designed to merely store compressed excitation-waveform data, so capacity required for the memory can be reduced.

17 Claims, 3 Drawing Sheets

ELECTRONIC MUSICAL INSTRUMENT WITH REDUCED STORAGE OF WAVEFORM INFORMATION

BACKGROUND OF THE INVENTION

1. Field of the Invention

The present invention relates to electronic musical instruments which synthesize musical tones based on waveform information stored by waveform memories.

2. Prior Art

Recently, physical-model sound sources are provided, as sound sources for the electronic musical instruments, to synthesize musical tones based on results of computation for physical behavior of musical instruments. The physical-model sound sources have rich musical expression, like acoustic instruments, with respect to growth process and decay process of the musical tones to be synthesized; and a manner of creation for tone colors is made natural with respect to those processes.

However, it is almost impossible to perfectly replace all of physical phenomena of acoustic instruments with electronic circuits, so the electronic musical instruments conventionally known cannot synthesize musical tones which are perfect equivalence of sounds actually produced by the acoustic instruments.

For this reason, some attempts are made to establish synthesis technology by which musical tones artificially synthesized perfectly match with the sounds of the acoustic instruments. One proposal for such a synthesis technology is provided by a paper of Japanese Patent Laid-Open No. 6-138880. Now, configuration of an electronic musical instrument, disclosed by this paper, will be explained with reference to FIGS. 4A and 4B.

FIG. 4A shows an analysis circuit; and FIG. 4B shows a synthesis circuit. In The analysis circuit of FIG. 4A, a signal representative of a target sound (hereinafter, referred to as a target-sound signal 'SDIN') is applied to one input of a subtracter 107, which then produces a subtraction signal. The subtraction signal is introduced into a loop circuit 101. The loop circuit 101 is configured by an adder 103 and a functional circuit 115. An output signal 'LI' of the functional circuit 115 is supplied to another input of the subtracter 107, so the output signal LI is subtracted from the target-sound signal.

The functional circuit 115 consists of a low-pass filter 111, a delay circuit 112, an all-pass filter 113 and a multiplier 114. The low-pass filter 111 is provided to simulate a phenomenon in which high-frequency components of musical tones will go eliminated as reflection of the musical tones is repeated. The delay circuit 112 is provided to set pitches for musical tones to be synthesized. The all-pass filter 113 is provided to perform minor adjustment for total delay time. The multiplier 114 is provided to simulate a phenomenon in which musical tones will go attenuated as reflection of the musical tones is repeated.

One input of the adder 103 receives the aforementioned subtraction signal (i.e., an output signal 'LO' of the subtracter 107), while another input receives the output signal LI of the functional circuit 115.

In the analysis circuit of FIG. 4A, when a target-sound signal SDIN is applied to the subtracter 107 so that an output signal LO of the subtracter 107 is supplied to the adder 103, the loop circuit 101 is driven so that a signal repeatedly circulates the loop circuit 101. The signal circulating the loop circuit 101 matches with characteristics which are set in the functional circuit 115. This signal is extracted as a musical tone signal having the characteristics set in the functional circuit 115.

In other words, the loop circuit 101 can synthesize a musical tone having the characteristics set in the functional circuit 115. A musical tone signal LI, which is synthesized, is subtracted from the target-sound signal SDIN so as to produce a signal LO. The signal LO is stored in a memory 105 as output of the analysis circuit.

The synthesis circuit of FIG. 4B is configured by the memory 105 as well as a loop circuit 101 whose configuration is similar to that of the loop circuit 101 in FIG. 4A.

In the synthesis circuit, a signal read out from the memory 105 is identical to the output signal LO of the subtracter 107 in the analysis circuit. So, the signal LO, read out from the memory 105, is applied to one input of an adder 103 in FIG. 4B. Both of the analysis circuit and synthesis circuit employ a same configuration of the loop circuit 101; therefore, by setting same coefficients for the functional circuits 115 respectively provided in the analysis circuit and synthesis circuit, a musical tone signal LI, outputted from the functional circuit 115 in the synthesis circuit of FIG. 4B, coincides with a musical tone signal LI outputted from the functional circuit 115 in the analysis circuit of FIG. 4A.

As described before, the signal LO in the analysis circuit is produced by subtracting the musical tone signal LI from the target-sound signal SDIN. Therefore, the synthesis circuit of FIG. 4B can reproduce the target-sound signal SDIN by adding the signal LO and the musical tone signal LI together. Thus, the adder 103, provided in the synthesis circuit of FIG. 4B, outputs the target-sound signal SDIN as an output signal 'OUT'.

Thus, it is possible to reproduce a musical tone which is an equivalence of the target-sound signal SDIN applied to the analysis circuit of FIG. 4A.

However, the aforementioned synthesis technology suffers from a problem that amount of data, which are outputted from the analysis circuit, should be large, therefore, memory capacity should be increased.

SUMMARY OF THE INVENTION

It is an object of the present invention to provide an electronic musical instrument which can reproduce musical tones with complete fidelity to target sounds by using a reduced amount of data.

The present invention provides an electronic musical instrument which comprises an analysis section, an excitation-waveform memory and a synthesis section. In the analysis section, difference data, which are calculated between target-sound data and output of an analysis loop, are subjected to compressive coding so that compressed data are produced. The compressed data are stored in the excitation-waveform memory as excitation-waveform data. The analysis loop, containing at least a delay circuit, is driven by an excitation signal which is produced by expanding the compressed data. In the synthesis section, the excitation-waveform data, read out from the excitation-waveform memory, are expanded; and expanded data are added to output of a synthesis loop, containing at least a delay circuit, so that musical tone data, representative of musical tones to be generated, are produced.

By arbitrarily selecting coefficients for compression and expansion, which are performed respectively in the analysis section and synthesis section, the musical tone data are controlled to be an equivalence of the target-sound data.

Further, the excitation-waveform memory is designed to merely store compressed excitation-waveform data, so memory capacity required for the memory can be reduced. Furthermore, the analysis section provides the analysis loop, which acts as a feedback loop; and consequently, noise of encoding, which may occur in the analysis section, can be reduced. Thus, it is possible to provide high-precision sound synthesis.

BRIEF DESCRIPTION OF THE DRAWINGS

These and other objects of the subject invention will become more fully apparent as the following description is read in light of the attached drawings wherein.

DESCRIPTION OF THE PREFERRED EMBODIMENT

Figure 1:
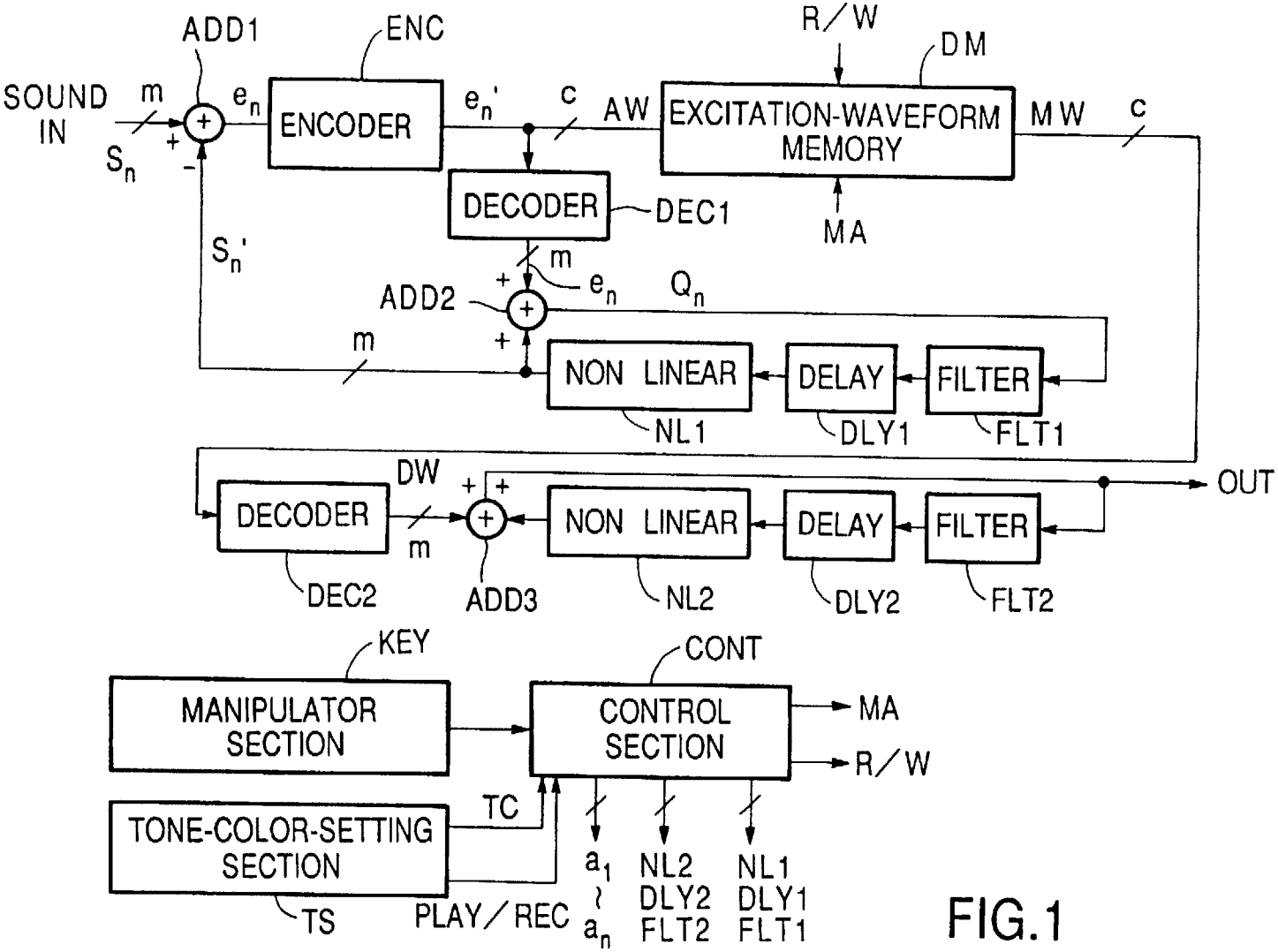
FIG. 1 is a block diagram showing configuration of an electronic musical instrument according to an embodiment of the present invention.

FIG. 1 is a block diagram showing essential configuration of an electronic musical instrument according to an embodiment of the present invention.

In FIG. 1, an encoder ENC is provided to perform compressive coding on data outputted from a subtracter ADD1; and a first decoder DEC1 is provided to expand the data which are subjected to the compressive coding by the encoder ENC. In addition, a first loop circuit is configured by connecting a first low-pass filter FLT1, a first delay circuit DLY1, a first non-linear circuit NL1 and a first adder ADD2 in a loop. The first loop circuit is driven by excitation waveforms given from the first decoder DEC1 to synthesize musical tone signals. Further, an excitation-waveform memory DM is provided to store compressed data which are outputted from the encoder ENC.

A second decoder DEC2 expands the compressed data which are read out from the excitation-waveform memory DM. Further, a second loop circuit is configured by connecting a second low-pass filter FLT2, a second delay circuit DLY2, a second non-linear circuit NL2 and a second adder ADD3 in a loop. The second loop circuit is driven by excitation waveforms, given from the second decoder DEC2, to synthesize musical tone signals.

A block 'KEY' represents a manipulator section corresponding to manual-operable members (or manipulators) for musical performance such as keys of a keyboard; a block 'TS' represents a tone-color-setting section by which tone-color-designating information plus a performance-designating signal and/or a recording-designating signal (i.e., PLAY/REC) are applied to a control section CONT. On the basis of information and signals given from the tone-color-setting section TS, the control section CONT produces coefficients a1 to an, which are provided for the encoder ENC, the first decoder DEC1 and the second decoder DEC2, as well as a variety of coefficients which are provided for the first and second loop circuits. Specifically, the control section CONT produces a coefficient NL1 for the first non-linear circuit, a coefficient DLY1 for the first delay circuit, a coefficient FLT1 for the first filter, a coefficient NL2 for the second non-linear circuit, a coefficient DLY2 for the second delay circuit and a coefficient FLT2 for the second filter. Furthermore, on the basis of event information, given from the manipulator section KEY, and PLAY/REC signals, given from the tone-color-setting section TS, the control section CONT produces read/write (R/W) control signals and addresses MA for the excitation-waveform memory DM.

Next, operations of the electronic musical instrument of FIG. 1 will be described in detail. At first, the description will be given with respect to operations in which the tone-color-setting section TS supplies a recording-designating signal 'REC' to the control section CONT so that the control section CONT writes an excitation waveform 'AW' into the excitation-waveform DM.

In this case, a target sound (which corresponds to a sound actually produced by an acoustic instrument, for example) is subjected to sampling process so as to produce a sound input which is represented by 'SOUND IN' in FIG. 1. The sound input is applied to the subtracter ADD1. Herein, the sound input is represented by input data Sn of m bits (where 'm' is an integer arbitrarily selected). In the subtracter ADD1, output data Sn' of m bits, which are outputted from the first loop circuit, are subtracted from the input data Sn so that difference data 'en' is produced. The difference data en are supplied to the encoder ENC in which they are subjected to compressive coding. As a result of the compressive coding, compressed difference data en' of c bits (where 'c' is an integer arbitrarily selected and m>c) are produced. The compressed difference data en' are written into the excitation-waveform memory DM as excitation-waveform data AW.

The compressed difference data en' are supplied to the first decoder DEC1 in which they are expanded so that original difference data of m bits are restored. The difference data en, outputted from the first decoder DEC1, are supplied to the first adder ADD2 as a signal which excites the first loop circuit. An excitation signal, received by the first adder ADD2, is supplied to the first filter FLT1, the first delay circuit DLY1 and the first non-linear circuit NL1 in turn. As described before, the first filter FLT1 simulates a phenomenon in which high-frequency components will go eliminated as reflection of a musical tone is repeated; the first delay circuit DLY1 sets a pitch for the musical tone to be synthesized; and the first non-linear circuit NL1 imparts a tone color to the musical tone synthesized by the first loop circuit. Then, an output signal of the first non-linear circuit NL1 is supplied to the first adder ADD2 in which it is added to the difference data en of m bits so that a signal 'Qn' is produced. The signal Qn repeatedly circulates through the first loop circuit, so a musical tone signal is synthesized. Thus, the output signal of the first non-linear circuit NL1 is transmitted to the subtracter ADD1 as the output data Sn'. An analysis loop is configured by the subtracter ADD1, the encoder ENC, the decoder DEC1 and the first loop circuit.

When the control section CONT supplies a R/W control signal to the excitation-waveform memory DM, the excitation-waveform memory DM is set at a write mode. At the write mode, when the control section CONT outputs an address MA, excitation-waveform data can be written into an area, designated by an address MA, in the excitation-waveform memory DM.

At a recording mode, the difference data en are calculated between the input data Sn, representative of the target sound, and the output data Sn' given from the first loop circuit; and the difference data en are compressed to the excitation-waveform data AW of c bits which are then stored in the excitation-waveform memory DM.

Thereafter, when the tone-color-setting section TS supplies the performance-designating signal PLAY to the control section CONT, the control section CONT controls the R/W control signal so as to turn the excitation-waveform memory DM at a read mode. At the read mode, the excitation-waveform data of c bits are read from the area, designated by the address MA, in the excitation-waveform memory DM; and then, read data are supplied to the second decoder DEC2 as a read waveform MW. In the second decoder DEC2, the read data are expanded to original data 'DW' of m bits, which are then introduced into the second loop circuit through the second adder ADD3 as a signal exciting the second loop circuit.

The data DW, received by the second adder ADD3, are transmitted to the second filter FLT2, the second delay circuit DLY2 and the second non-linear circuit NL2 in turn. As described before, the second filter FLT2 simulates a phenomenon in which high-frequency components will go eliminated as reflection of a musical tone is repeated; the second delay circuit DLY2 sets a pitch for the musical tone to be synthesized by the second loop circuit; and the second non-linear circuit NL2 imparts a tone color to the musical tone synthesized by the second loop circuit. Then, an output signal of the second non-linear circuit NL2 is supplied to the second adder ADD3 in which it is added to the data DW of m bits. Thus, since a signal repeatedly circulates through the second loop circuit at a performance mode, the output signal 'OUT' is synthesized by the second loop circuit and is extracted as a musical tone signal.

Meanwhile, the signal Qn, which circulates the first loop circuit, is calculated as follows:

$$Qn=Sn'+en \quad (1$$

Thus, the difference data en is calculated as follows:

$$en=Sn-Sn' \quad (2)$$

So, an equation (1) can be rewritten, using an equation (2), as follows:

$$Qn=Sn'+en=Sn'+(Sn-Sn')=Sn$$

This indicates that the input data Sn, representative of the target sound, is theoretically equivalent to the signal which circulates the first loop circuit.

Further, the excitation-waveform data AW, which are stored in the excitation-waveform memory DM, are identical to the compressed difference data en'. Therefore, the read waveform MW is equivalent to the compressed difference data en'. Thus, the data DW, which are expanded by the second decoder DEC2, are equivalent to the difference data en.

Since the difference data en are equal to the data DW, the same data are supplied to both of the first loop circuit and second loop circuit as an excitation signal. In that sense, when coefficients, used by the first loop circuit, are made equal to coefficients, used by the second loop circuit, the musical tone signal OUT, which circulates the second loop circuit, should be identical to the signal Qn which circulates the first loop circuit. As a result, a musical tone, which is equivalent to the target sound, is synthesized by the second loop circuit as the musical tone signal OUT.

According to the synthesis technology of the present embodiment, the excitation-waveform memory DM can be designed to store data of c bits, an amount of which is smaller than original data of m bits. So, it is possible to reduce capacity of the excitation-waveform memory DM.

Upon receipt of the tone-color-designating information TC from the tone-color-setting section TS, the control section CONT produces a set of the coefficients NL1, DLY1 and FLT1 for the first loop circuit as well as a set of the coefficients NL2, DLY2 and FLT2 for the second loop circuit. If the coefficients NL1, DLY1 and FLT1 are respectively equal to the coefficients NL2, DLY2 and FLT2, it is possible to synthesize the musical tone signal OUT which is equivalent to the target-sound data Sn as described before. By changing the coefficients NL2 and FLT2, it is possible to change the tone color. Further, by changing the coefficient DLY2, it is possible to change the pitch of the musical tone signal.

Moreover, at the recording mode, the coefficient DLY1 of the first delay circuit is adjusted in such a way that excitation-waveform data AW will have a pitch of the target-sound data Sn; and the excitation-waveform data AW are stored in the excitation-waveform memory DM. Such a storing manner of the excitation-waveform memory DM can be changed as follows:

A certain target sound is inputted with respect to each of tone pitches which are used for musical performance, so all of the tone pitches, corresponding to the excitation-waveform data AW, are stored by the excitation-waveform memory DM. Or, excitation-waveform data AW are produced with respect to a certain register (or a certain sound-frequency range) in such a way that characteristics of an original sound are not damaged; and then, the excitation-waveform data AW are stored in the excitation-waveform memory DM.

Meanwhile, the analysis loop, corresponding to the first loop circuit, is configured as a feedback loop wherein noise of encoding, which may occur in the analysis loop, is inverted and is returned to the sound input. Therefore, it is possible to reduce (or cancel) the noise of encoding. As a result, the present embodiment has a high precision in sound synthesis.

The electronic musical instrument described heretofore is designed to provide both of the analysis loop and synthesis loop. However, the present invention is not limited by such a configuration providing two loops. So, the present embodiment can be modified in such a way that only the analysis loop with the excitation-waveform memory is provided or only the synthesis loop with the excitation-waveform memory is provided.

Meanwhile, the coefficients a1 to an, produced by the control section CONT, are respectively supplied to the encoder ENC as well as the first decoder DEC1 and the second decoder DEC2. For design of the encoder ENC, the first decoder DEC1 and the second decoder DEC2, it is possible to employ any one of compressive coding technologies such as DPCM (i.e., Differential Pulse Code Modulation), ADPCM (Adaptive Differential Pulse Code Modulation) and LPC (Linear Predictive Coding). Examples of configuration using such a compressive coding technology are shown by FIGS. 2 and 3.

Figure 2:
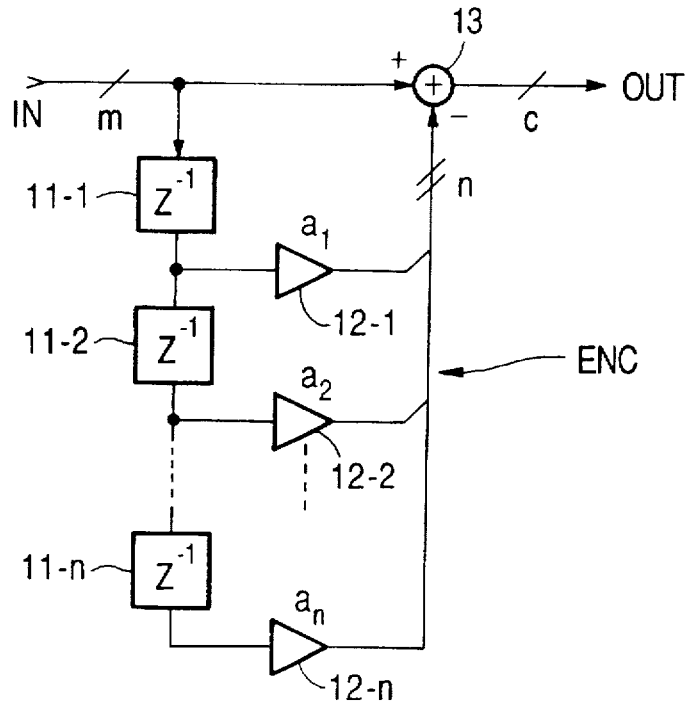
FIG. 2 is a circuit diagram showing an example in configuration of an encoder which is applicable to the present invention.

FIG. 2 shows an example in configuration of the encoder ENC. The encoder ENC is configured by a subtracter 13, delay elements 11-1 to 11-n and coefficient multipliers 12-1 to 12-n. Herein, the delay elements are arranged in a multiple-cascade-connection manner; and each of them provides a delay of one-sample time. The coefficient multipliers 12-1 to 12-n multiply output signals of the delay elements 11-1 to 11-n respectively by coefficients a1 to an.

In the encoder ENC of FIG. 2, input data 'IN' of m bits are delayed by the delay elements 11-1 to 11-n, from which delayed data are respectively outputted. Then, the delayed data of the delay elements 11-1 to 11-n are supplied to the multipliers 12-1 to 12-n in which they are respectively multiplied by the coefficients a1 to an. Results of the multiplication performed by the multipliers 12-1 to 12-n are combined together to form a predictive signal which is then supplied to the subtracter 13. The subtracter 13 subtracts the predictive signal from the input data IN to produce compressed data of c bits. Herein, the compressed data of c bits are compressed as compared to the input data IN of m bits. The compressed data are provided as output data 'OUT' of the encoder of FIG. 2. Incidentally, the coefficients a1 to an, which are set for the multipliers 12-1 to 12-n respectively, are determined in such a way that prediction can be made well with responding to sharpness (or degree of timed-variation) of the input data; in other words, those coefficients are determined in such a way that average between encoded signals are minimized.

Figure 3:
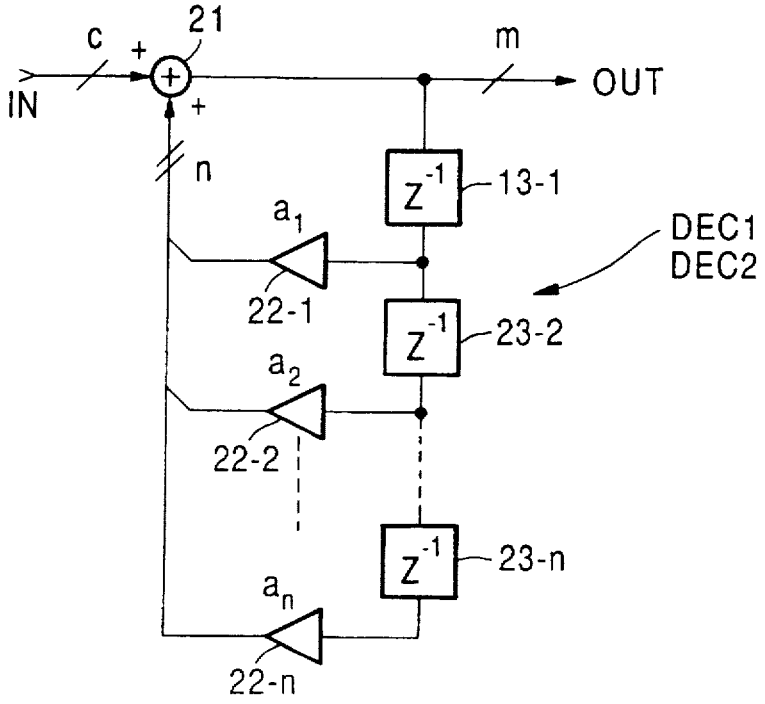
FIG. 3 is a circuit diagram showing an example in configuration of a decoder which is applicable to the present invention.
Figure 4A:
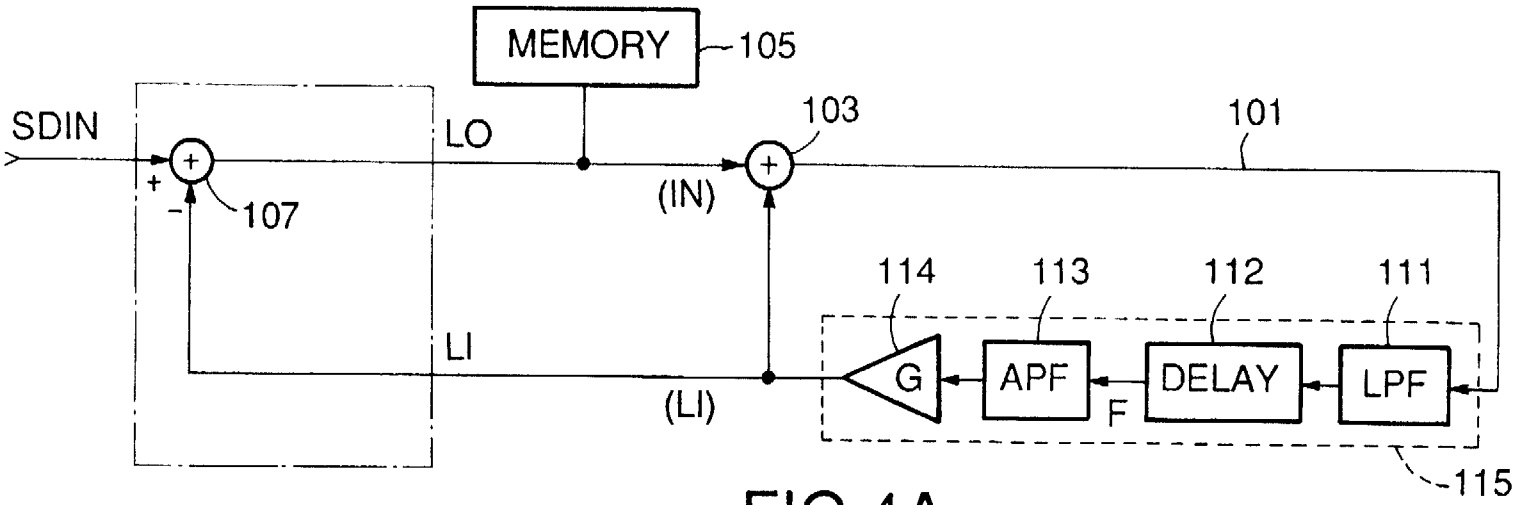
FIG. 4A shows an example of the analysis circuit of the conventional electronic musical instrument.
Figure 4B:
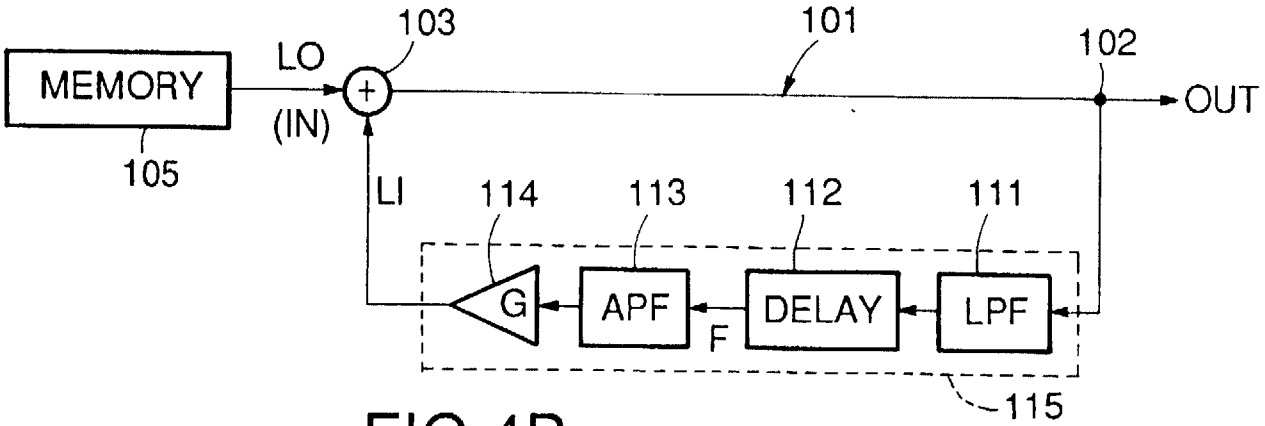
FIG. 4B shows an example of the synthesis circuit of the conventional electronic musical instrument.

Next, FIG. 3 shows an example in configuration of a decoder which is employed as the first decoder DEC1 and/or the second decoder DEC2. The configuration of the decoder of FIG. 3 is somewhat a reversed one as compared to the configuration of the encoder of FIG. 2.

The decoder of FIG. 3 is configured by an adder 21, delay elements 23-1 to 23-n, each having one-sample delay time, and coefficient multipliers 22-1 to 22-n. Herein, the delay elements 23-1 to 23-n are connected together in a multiple-cascade-connection manner, while the coefficient multipliers 22-1 to 22-n multiply output data of the delay elements 23-1 to 23-n respectively by the coefficients a1 to an.

The decoder of FIG. 3 receives compressed data of c bits 'IN'. The compressed data IN pass through the adder 21; and they are supplied to the delay elements 23-1 to 23-n, from which delayed data are respectively outputted. Each of the delayed data has a different delay time. The delayed data of the delay elements 23-1 to 23-n are respectively supplied to the multipliers 22-1 to 22-n in which they are respectively multiplied by the coefficients a1 to an. Results of multiplication of the multipliers 22-1 to 22-n are combined together to form a predictive signal, which is then supplied to the adder 21. The predictive signal is added to the compressed data IN; and consequently, the compressed data of c bits are expanded to reproduce data of original 'm' bits. The data of m bits are provided as output data 'OUT' of the decoder of FIG. 3. As described above, a same set of coefficients a1 to an are used for the multipliers 22-1 to 22-n, in FIG. 3, as well as the multipliers 12-1 to 12-n in FIG. 2. However, it is possible to change the coefficients used by the decoder of FIG. 3 so that a tone color is changed.

The electronic musical instrument of the present invention does not necessarily provide a set of analysis section and synthesis section. In other words, the present invention can be configured only using the synthesis section if its memory stores excitation-waveform data AW which are produced by the analysis section.

In addition, the present embodiment can be modified in such a way that the analysis section and synthesis section are directly connected together without intervening a memory. In such a modification, an appropriate musical tone is applied as "SOUND IN"; and two data, which are respectively extracted from the analysis section and synthesis section, are combined together in an appropriate manner so as to activate generation of the musical tone or to process the musical tone. Further, coefficients, used by the encoder and decoder, can be changed independently so as to generate musical tones of brand-new tone colors.

Moreover, each of the analysis section and synthesis section can be configured using some hardware elements; or it can be realized by software process which is run by a digital signal processor (i.e., DSP).

Incidentally, programs corresponding to algorithms of the present invention can be provided as application programs which are executed by personal computers and the like. So, by executing the algorithms on the personal computer, it is possible to produce musical tones.

In FIG. 1, a section between 'SOUND IN' and 'AW' and a section between 'MW' and 'OUT' are required merely for creating data of the excitation-waveform memory. So, those sections are not necessarily built in the electronic musical instrument or musical tone synthesizing apparatus; in other words, those sections can be provided in form of independent devices.

Lastly, operations or algorithms of the present invention can be realized not only in form of the electronic musical instrument but also in form of the musical tone synthesizing apparatus.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within meets and bounds of the claims, or equivalence of such meets and bounds are therefore intended to be embraced by the claims.

What is claimed is:

1. An electronic musical apparatus comprising:

analysis means for analyzing target sound data, said analysis means having at least an analysis loop including a first delay element which provides a delay corresponding to a pitch of a target sound, data combining means for combining said target sound data with data output by said analysis loop, data compression means for compressing data output by said combining means, data decompression means for decompressing compressed data output by said data compression means, wherein an input of said analysis loop is responsive to decompressed data output by said data decompression means;

an excitation waveform memory for storing compressed data output by said data compression means as excitation waveform data; and synthesis means for generating a musical tone utilizing excitation waveform data read from said excitation waveform memory.

2. An electronic musical apparatus according to claim 1 wherein a frequency characteristic of the analysis means is a reverse of a frequency characteristic of the synthesis means.

3. An electronic musical apparatus according to claim 1, wherein the synthesis means comprises:

a decoder for decompressing excitation waveform data read from said excitation waveform memory;

a synthesis loop including at least a second delay element which provides a delay corresponding to a pitch of said target sound and second combining means for combining data circulating through said synthesis loop with an output of said decoder.

4. An electronic musical apparatus according to claim 1 wherein the target sound data consist of m bits and the excitation waveform data consist of c bits, and c is less than m.

5. An electronic musical apparatus according to claim 1, wherein said synthesis means includes second data decompression means for decompressing said excitation waveform data read from said excitation waveform memory.

6. An electronic musical apparatus according to claim 1, wherein at least one of said analysis means and said synthesis means is implemented at least partially in software.

7. An electronic musical apparatus according to claim 1, wherein said musical tone is equivalent to said target sound.

8. An electronic musical apparatus according to claim 1, wherein said musical tone is a modified version of said target sound.

9. An electronic musical instrument comprising:

a subtracter for performing subtraction using target-sound data of m bits where m is an integer arbitrarily selected, representative of a target sound, so as to produce difference data of m bits;

an encoder for performing compressive coding on the difference data of m bits so as to produce compressed data of c bits where "c" is an integer arbitrarily selected and is less than "m", the compressed data being provided as excitation-waveform data stored by an excitation-waveform memory;

a first decoder for expanding the compressed data of c bits to reproduce data of m bits which are used as an excitation signal;

an analysis loop which provides at least first delay means which provides a delay corresponding to a pitch of the target sound and which is driven by the excitation signal so as to produce output data of m bits which are subtracted from the target-sound data of m bits by the subtracter;

a second decoder for expanding the excitation-waveform data, read out from the excitation-waveform memory, so as to produce data of m bits; and a synthesis loop which provides at least second delay means which provides a delay corresponding to a pitch of the target sound, wherein output of the synthesis loop is added to the data of m bits, outputted from the second decoder, so as to produce musical tone data representative of a musical tone to be generated which corresponds to the target sound.

10. An electronic musical instrument according to claim 9 wherein the encoder comprises an subtracter, a plurality of delay elements and a plurality of multipliers, which are connected together in a multiple-cascade-connection manner, while either the first decoder or the second decoder is configured by a decoder comprising an adder, a plurality of delay elements and a plurality of multipliers, which are connected together in a multiple-cascade-connection manner; and wherein a same set of coefficients are used by each of the encoder and the decoder and are determined in such a way that the musical tone data are controlled to be an equivalence of the target-sound data.

11. A media readable by a machine and containing program code, said program code comprising:

analysis means for instructing said machine to analyze target sound data, said analysis means having at least an analysis loop including a first delay element which provides a delay corresponding to a pitch of a target sound, combining means for instructing said machine to combine said target sound data with data output by said analysis loop, data compression means for instructing said machine to compress data output by said combining means, data decompression means for instructing said machine to decompress compressed data output by said data compression means, wherein an input of said analysis loop is responsive to decompressed data output by said data decompression means;

writing means for instructing said machine to write compressed data output by said data compression means as excitation waveform data to an excitation waveform memory; and synthesis means for instructing said machine to generate a musical tone utilizing excitation waveform data read from said excitation waveform memory.

12. The media of claim 11, wherein a frequency characteristic of said analysis means is a reverse of a frequency characteristic of said synthesis means.

13. The media of claim 11, wherein said synthesis means comprises:

a decoder for instructing said machine to decompress excitation waveform data read from said excitation waveform memory;

a synthesis loop including at least a second delay element for providing a delay corresponding to a pitch of said target sound and second combining means for instructing said machine to combine data circulating through said synthesis loop with an output of said decoder.

14. The media of claim 11, wherein the target sound data consist of m bits, and the excitation waveform data consist of c bits, and c is less than m.

15. The media of claim 11, wherein said synthesis means includes second data decompression means for instructing said machine to decompress said excitation waveform data read from said excitation waveform memory.

16. The media of claim 11, wherein said musical tone is equivalent to said target sound.

17. The media of claim 11, wherein said musical tone is a modified version of said target sound.

* * * * *